United States Patent [19]

Harms

[11] 4,023,519

[45] May 17, 1977

[54] COUPLING FOR MARINE VESSELS

[75] Inventor: Horst Harms, Bremerhaven, Germany

[73] Assignee: Aktiengesllschaft "Weser", Bremen, Germany

[22] Filed: June 23, 1975

[21] Appl. No.: 589,280

[30] Foreign Application Priority Data

June 25, 1974 Germany ..... 2430468

[52] U.S. Cl. ..... 114/247; 114/251

[51] Int. Cl.[2] ..... B63D 21/56

[58] Field of Search ..... 254/184, 185 R, 185 A, 254/185 B; 114/242, 246, 247, 248, 249, 251, 253, 254

[56] References Cited

UNITED STATES PATENTS

| | | | |
|---|---|---|---|
| 2,271,427 | 1/1942 | Harry | 254/184 |
| 2,370,834 | 3/1945 | Ball | 254/184 |
| 2,870,734 | 1/1959 | Armstrong et al. | 114/235 R |
| 2,922,625 | 1/1960 | Heacock | 254/185 R |
| 3,461,829 | 8/1969 | Mosvold | 114/235 R |
| 3,645,225 | 2/1972 | Lunde | 114/235 R |

FOREIGN PATENTS OR APPLICATIONS

| | | | |
|---|---|---|---|
| 2,001,996 | 7/1971 | Germany | 114/235 A |
| 1,481,889 | 1/1966 | Germany | 254/184 |

*Primary Examiner*—Trygve M. Blix
*Assistant Examiner*—Stuart M. Goldstein
*Attorney, Agent, or Firm*—Michael J. Striker

[57] ABSTRACT

A thrust coupling connects the stern of a pushed vessel with the bow of a pushing vessel, allowing relative movement of the vessels about a vertical axis. A pair of elongated flexible ropes extend between the vessels, one on each side, and they each have one end portion connected to the pushed vessel and another end portion which is connected to one of a pair of coaxial winch drums that are rotatably mounted on the pushing vessel in the region of the stern of the latter. The end portion of one rope is convoluted about one of the drums in one direction and the end portion of the other rope is convoluted about the other drum in the opposite direction. A drive is provided which permits the drums to be jointly rotated, or individually rotated, at the option of a user.

8 Claims, 3 Drawing Figures

COUPLING FOR MARINE VESSELS

BACKGROUND OF THE INVENTION

The present invention relates to marine vessels, and in particular to a coupling for marine vessels. Still more specifically the present invention relates to an apparatus for coupling together a pushing vessel and a pushed vessel so that one of the vessels can act as a rudder for steering the other vessel.

It is already known to push one marine vessel with another, rather than to tow it. The application of so-called "push-towing" was originally confined to protected waters, but has in recent years been extended to rough-water areas also. It is of course possible not only to push a single vessel, such as a barge or lighter, but to push a whole string of such vessels with a single pushing vessel. The pushing vessel has it bow connected with the stern of the pushed vessel, or with the stern of that one of a string of pushed vessels that is closest to the bow of the pushing vessel, by means of a thrust coupling that is usually centrally located on the cooperating bow and stern.

In order to be able to maneuver, that is to be able to use the pushing vessel in its entirety as an active rudder for steering the single or multiple pushed vessels, rope or cable tackle is arranged which extends laterally of the connected vessels and is multiple-reeved so as to be trained about two direction-changing instrumentalities, e.g. rollers or the like. One of these instrumentalities of each tackle is located as far astern on the pushing vessel as possible, and the other is mounted on the stern of the pushed vessel, as far laterally offset from the longitudinal center line of the vessel as possible. One end of each tackle is fixedly mounted and the other end of the tackle is connected to a winch or an analogous device, for example a hydraulic or pneumatic cylinder and piston unit, for the purpose of tensioning or relaxing the respective tackle. By tensioning the tackle on one side and relaxing it on the other side, the pushed vessel and the pushing vessel can be made to perform relative to one another a movement about a vertical axis that is defined by the thrust coupling, so that the pushing vessel acts in its entirety as a rudder for steering the pushed vessel.

However, the constructions known from the prior art do not permit precise individual control of the tackle at the respective sides of the pushing vessel, so that the maneuverability of a coupled pushing and pushed vessel is relatively imprecise. This of course has the disadvantage of not only making it difficult to maneuver the connected vessels, but also of increasing the danger of accidents since the inadequate maneuverability makes it more difficult to avoid collisions and the like.

Moreover, the prior-art constructions require specialized winch constructions, insofar as they use winches, which must be designed for the particular application and are therefore relatively expensive. Standard winches cannot be used.

SUMMARY OF THE INVENTION

Accordingly, it is an object of the present invention to increase the maneuverability of an apparatus of the type in question, and concomitantly to increase the safety of vessels using such an apparatus.

An additional object of the invention is to provide such an apparatus wherein the control over the tackles connecting the pushed and the pushing vessel is more individualized and precise than was heretofore possible.

Still a further object of the invention is to provide such an apparatus wherein conventional winches can be used, i.e. winches of general type and not winches which have been especially constructed for use only with the apparatus in question.

In keeping with these objects, and with others which will become apparent hereafter, one feature of the invention resides in an apparatus for coupling together a pushing vessel and a pushed vessel and for steering the coupled vessels. Briefly stated, the apparatus comprises thrust coupling means operatively connecting the stern of the pushed vessel with the bow of the pushing vessel and allowing relative movement of these vessels about a vertical axis. A pair of elongated flexible connecting means are provided, extending between the vessels, one on each side, and each having one end portion connected to the pushed vessel and another end portion. A pair of coaxial winch drums is rotatably mounted on the pushing vessel, and one of the connecting means has its other end portion convoluted about one of the drums in one direction whereas the other of the connecting means has the other end portion thereof convoluted about the other of the drums in an opposite direction. Drive means is provided for rotating the drums jointly or separately, at the option of a user.

The drive means includes a separate drive motor for each of the winches, and advantageously a separate brake is also provided for each of the winches in order to stop the respective winches from rotating if and when desired, for example when the drive is switched off.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
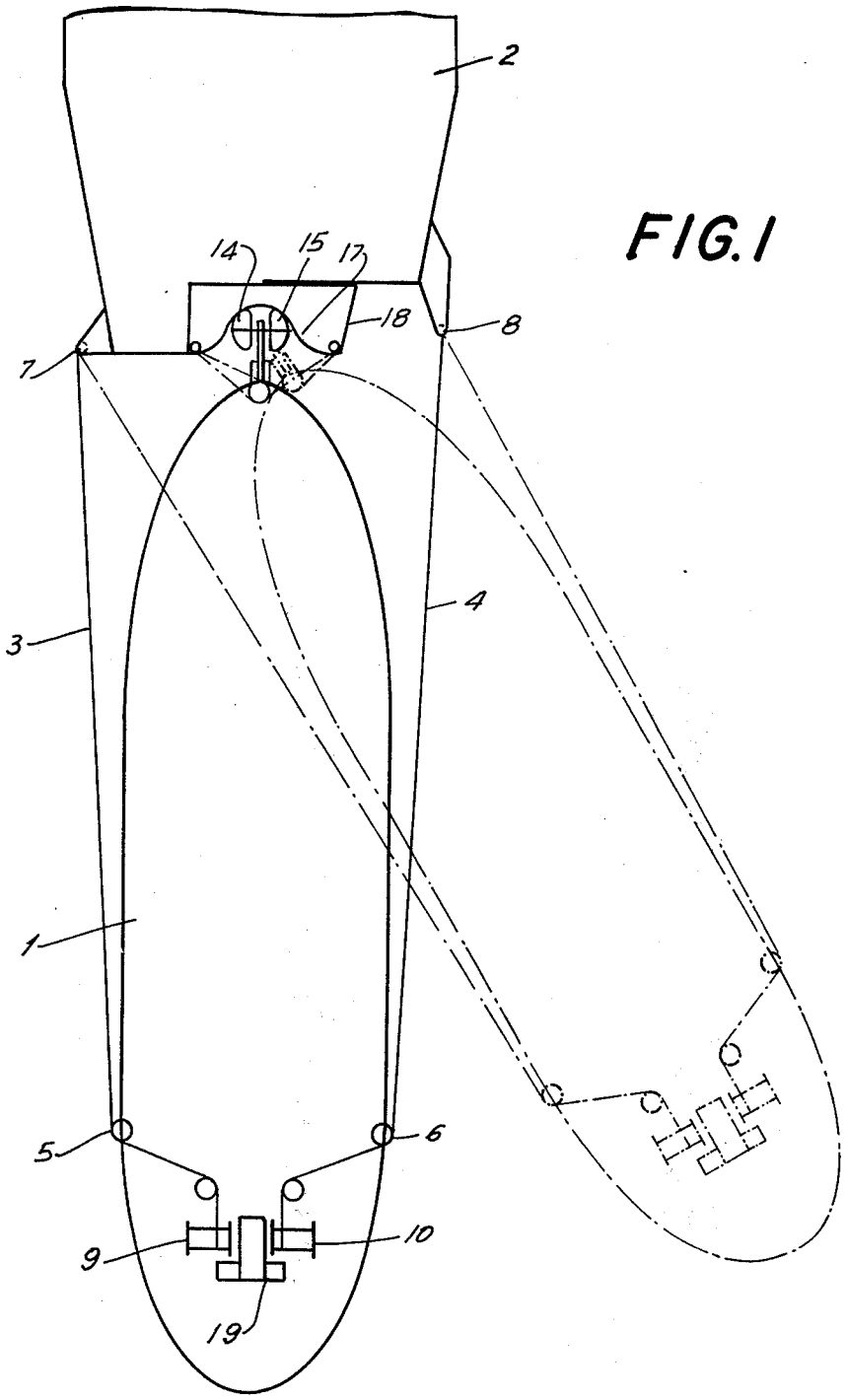
FIG. 1 is a somewhat diagrammatic top-plan view illustrating two coupled vessels which include the apparatus of the present invention.
Figure 2:
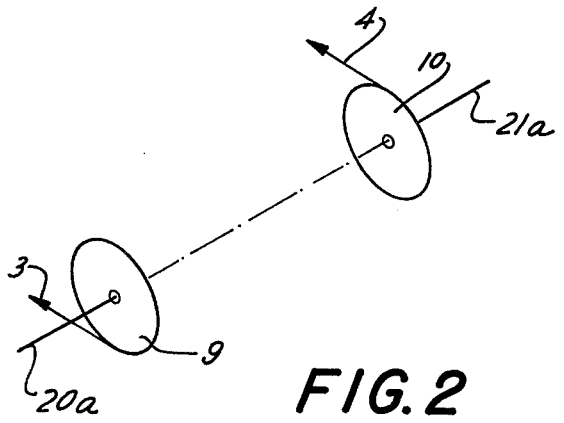
FIG. 2 is a diagrammatic end view of each of the winches used in the apparatus, looking towards the right in FIG. 3.
Figure 3:
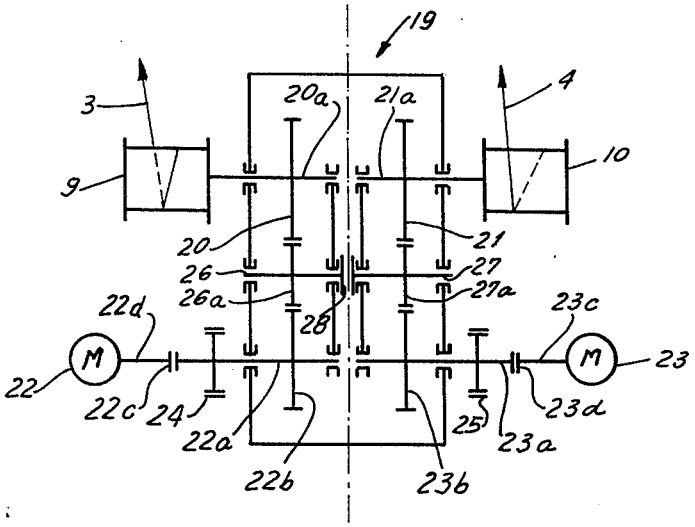
FIG. 3 is a diagrammatic top-plan view of the drive of the apparatus in FIG. 1, utilizing the drums shown in FIG. 2.

Referring now to the drawing in detail, which in FIGS. 1–3 shows a single exemplary embodiment of the invention, it will be seen that reference numeral 1 identifies a pusher boat, i.e. a tug which pushes rather than pulls one or more (one shown) lighter 2. The tug may be of the ocean-going type or it may be of the harbor type. The vessels 1 and 2 are connected with one another by a thrust coupling which is interposed between the bow of the tug 1 and the stern of the adjacent lighter 2. In the illustrated embodiment the thrust coupling is composed of two vertically elongated coupling parts 14, 15 which are of approximately semi-circular cross-section and which are mounted on a holder so that they can pivot about a horizontal axis, the holder being mounted on the bow of the tug 1. The coupling parts 14, 15 can move vertically up and down in a vertical recessed track 17 that is formed in a reinforcing portion 18 on the stern of the lighter 2. This thrust coupling is exemplary only, and any of the thrust couplings known from the prior art for this purpose can be utilized, for instance the type disclosed in U.S. Pat. No. 3,461,829 or that disclosed in U.S. Pat. No. 3,645,225. The vertical movement up and down can be dampened by shock absorbers.

To be able to use the tug 1 in its entirety as a rudder for steering the combination of tug and lighter or lighters, tiller lines 3, 4 are provided which may also be in form of single or multi-reeved tackle. The one ends of the tiller lines 3, 4 are connected to the stern of the lighter 2 at the locations 7 and 8, respectively, i.e. as far away laterally from the thrust coupling 14, 15 as possible. The tiller lines 3, 4 extend at opposite lateral sides of the tug 1, their other ends which are remote from the stern of the lighter 2 being trained about rollers or similar guiding devices 5, 6 on board the tug 1 and being connected to powered winch drums 9 and 10, respectively. The devices 5, 6 should be as far towards the stern of the tug 1 as possible. By tightening one and loosening the other of the tiller lines 3, 4 the tug 1 can be made to move with reference to the lighter 2 about a vertical axis to a laterally displaced position as shown in broken lines in FIG. 1, or of course to the opposite lateral side, or to a position intermediate the full line and the broken-line position.

The ends of the tiller lines 3, 4 are convoluted about the winch drums 9, 10 in mutually opposite directions, as illustrated diagrammatically in FIG. 2.

The winch drums 9, 10 are mounted coaxially and powered by a drive means 19 that is shown in more detail in FIG. 3.

As FIG. 3 shows, the winch drums 9 and 10 are mounted on respective shafts 20*a*, 21*a* each of which also carries a gear 20, 21, respectively. A pair of further shafts 22*a* and 23*a* is provided, each carrying a further gear 22*b* which cooperates with the gear 20 and a gear 23*b* which cooperates with the gear 21. The cooperation is not direct, but rather is indirect. For this purpose the drive means 19 further includes two intermediate shafts 26 and 27, respectively, which carry gears 26*a* and 27*a*, respectively. The gear 26*a* meshes with the gears 20 and 22*b* and the gear 27*a* meshes with the gears 21 and 23*b*.

Each of the shafts 22*a* and 23*a* can be driven by its own motor 22 and 23, respectively. For this purpose the motor 22 has an output shaft 22*d* and a coupling 22*c* is provided which can couple the output shaft 22*d* to and uncouple it from the shaft 22*a*. Similarly, the motor 23 has an output shaft 23*c* which can be coupled to and uncoupled from the shaft 23*a* by means of a coupling 23*d*. A further coupling 28 is provided by means of which the shafts 26 and 27 can be coupled with one another for joint rotation, thus making it possible to either rotate the shafts 26, 27 and therefore the gears 26*a* and 27*a* in unison with one another, or, by uncoupling them via the coupling 28, allowing them to operate separately. Thus, the winch drums 9 and 10 can be driven individually or in unison via the motors 22, 23.

Couplings of the type identified with reference numerals 22*c*, 23*c* and 28 are already known in the art, for example as described in Navy training course NAVPERS 10524-C, issued by the U.S. Bureau of Naval Personnel. The motors 22 and 23 are advantageously fluid motors, also as known in the art and described in the aforementioned Naval Personnel training course.

It is advantageous if the shafts 22*a* and 23*a* are provided with respective individual brakes 24 and 25, which may be band brakes, i.e. drums mounted fixedly on the shafts for rotation therewith and surrounded by bands of steel or the like which carry on their sides facing the peripheral surfaces of the drums brake linings, so that when the bands are tightened into engagement of the drums they will cause the rotation of the drums with the braked.

It will be seen that the drive means 19 thus makes it possible to drive the winch drums 9, 10 via the direction-reversible motors 22, 23 in one or the other direction, jointly or individually.

The arrangement of the present invention makes it possible not only to use the tug 1 as a rudder in its entirety, but also to fix it in position relative to the lighter or lighters 2, in any position which may have been selected, simply by moving the tug 1 to the desired position by tightening one and relaxing the other of the tiller lines 3, 4, and thereupon fixing the winch drums 9, 10 against further rotation (and fixing the tiller lines against further slackening or tensioning) by operating the drums 24 and 25. Evidently, in operaion of the drive means 19 one of the tiller lines will be paid out whereas the other one will be taken up, or vice versa. To tension them, the two drums 9, 10 may be operated separately by disengaging the coupling 28, and separate operation can also be used for specific steering applications. During normal travel of the tug 1 connected with the lighter or lighters 2 the coupling 28 may be engaged so that the winch drums 9, 10 can be rotated jointly to thereby simplify the operation of the drive means for maneuvering purposes.

A further advantage of the present invention is the fact that in the event the motors 22 and/or 23 should fail, the maneuverability of the connected vessels will not be adversely affected because the brakes 24, 25 may be released or engaged as necessary to permit lengthening or shortening of the tiller lines 3, 4 due to pull exerted by these lines upon the winch drums 9, 10. It is advantageous in such an instance if the coupling 28 is engaged so that the shafts 26 and 27 rotate jointly. The maneuvering will then be caused by operating the rudder of the tug 1, to place the tug 1 into a different position relative to the lighter 2 than previously, and during such movement one of the tiller lines 3, 4 will lengthen and, since the rotation of the winch drum from which this one tiller line is being withdrawn will cause a simultaneous rotation of the opposite winch drum, the other tiller line will be taken up upon this opposite winch drum. Once a desired relative angular position between tug 1 and lighter 2 has been reached, it can be fixed by actuating the brakes 24, 25 and additional winches are not required.

It will be understood that each of the elements described above, or two or more together, may also find a useful application in other types of constructions differing from the types described above.

While the invention has been illustrated and described as embodied in an apparatus for coupling together a pushing vessel and a pushed vessel, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for coupling together a pushing vessel and a pushed vessel and for steering said coupled vessels, comprising thrust coupling means operatively connecting the stern of the pushed vessel with the bow of the pushing vessel and allowng relative movement of said vessels about a vertical axis; a pair of elongated flexible connecting means extending between said vessels, one on each side, and each having one end portion connected to the pushed vessel and another end portion; a pair of coaxial winch drums rotatably mounted on said pushing vessel; and drive means, comprising means for coupling said drums jointly or separately with said drive means so that said drums may be rotated jointly or separately, at the option of the user, one of said connecting means having said other end portion thereof convoluted about one of said drums in one direction and the other of said connecting means having said other end portion thereof convoluted about the other of said drums in an opposite direction so that, when said drums are rotated jointly in the same direction, taking-up of one of said connecting means on one of said drums is accompanied by paying-out of the other connecting means from the other of said drums, and vice versa.

2. An apparatus as defined in claim 1, wherein said drive means comprises a gear transmission.

3. An apparatus for coupling together a pushing vessel and a pushed vessel and for steering said coupled vessels, comprising thrust coupling means operatively connecting the stern of the pushed vessel with the bow of the pushing vessel and allowing relative movement of said vessels about a vertical axis; a pair of elongated flexible connecting means extending between said vessels, one on each side, and each having one end portion connected to the pushed vessel and another end portion; a pair of coaxial winch drums rotatably mounted on said pushing vessel, one of said connecting means having said other end portion thereof convoluted about one of said drums in one direction and the other of said connecting means having said other end portion thereof convoluted about the other of said drums in an opposite direction; and drive means including a gear transmission comprising a first pair of shafts each carrying one of said drums and a first gear, a second pair of shafts which are driven in rotation and each carry a second gear, and a third pair of shafts each carrying a third gear that meshes with one of said first and second gears, said drive means further comprising means for coupling said drums jointly or separately with said drive means so that said drums may be rotated jointly or separately, at the option of a user.

4. An apparatus as defined in claim 3, wherein said coupling means is operated for selectively coupling and uncoupling said shafts of said third pair from one another so that said shafts of said third pair rotate jointly or separately, at the option of a user.

5. An apparatus as defined in claim 3, wherein said drive means further comprises two motors, each operative for rotating one of said second shafts.

6. An apparatus as defined in claim 5, wherein said coupling means is operative for selectively coupling each of said motors with a respective one of said second shafts.

7. An apparatus as defined in claim 3, wherein said drive means further comprising braking means for braking the rotation of said drums.

8. An apparatus as defined in claim 7, wherein said braking means comprises a pair of brakes, each acting upon one of said second shafts.

* * * * *